US005497708A

United States Patent [19]

Jeruzal

[11] Patent Number: 5,497,708

[45] Date of Patent: Mar. 12, 1996

[54] PALLET WITH ADJUSTABLE ARTICLE MOUNTING HARDWARE AND ARTICLE ATTACHMENT METHOD

[75] Inventor: Thomas M. Jeruzal, Brighton, Mich.

[73] Assignee: Chrysler Corporation, Highland Park, Mich.

[21] Appl. No.: 315,388

[22] Filed: Sep. 30, 1994

[51] Int. Cl.[6] ..... B65D 19/00

[52] U.S. Cl. ..... 108/54.1; 108/901; 108/55.3; 206/386; 206/335; 248/503.1

[58] Field of Search ..... 108/54.1, 901, 108/51.1, 55.5, 53.1, 55.3, 902; 206/386, 335; 248/346, 501, 503.1; D34/38; 269/900

[56] References Cited

U.S. PATENT DOCUMENTS

| | | | |
|---|---|---|---|
| 2,828,931 | 4/1958 | Harvey | 108/54.1 X |
| 3,396,678 | 8/1968 | Jensen | 108/55.5 X |
| 3,493,201 | 2/1970 | Marran | 248/346 X |
| 4,015,710 | 4/1977 | Biggs | 206/386 |
| 4,896,612 | 1/1990 | Salloum | 108/901 X |
| 4,911,084 | 3/1990 | Sato et al. | 108/51.1 |
| 4,934,720 | 6/1990 | Dobron | 108/56.1 X |
| 4,978,097 | 12/1990 | Froutzis | 248/503.1 |
| 5,042,396 | 8/1991 | Shuert | 108/51.1 |
| 5,101,964 | 4/1992 | Westphal | 108/51.1 X |
| 5,329,862 | 7/1994 | Breezer et al. | 108/55.5 |

FOREIGN PATENT DOCUMENTS

| | | | |
|---|---|---|---|
| 5-330555 | 12/1993 | Japan | 108/55.5 |

*Primary Examiner*—Peter M. Cuomo
*Assistant Examiner*—Janet M. Wilkens
*Attorney, Agent, or Firm*—Edward A. Craig

[57] ABSTRACT

A multiple section pallet assembly having a primary pallet member fitted with adjustable article attachment brackets thereon to accommodate and attach a wide range of articles such as vehicle seats of varying sizes. For seat attachment, a support tray and support pedestals adjustably secured to the brackets have connector pins to fit into associated pin openings in seat structure so that the seats can be readily and securely mounted on the pallet member for conveyance and subsequently easily removed therefrom. The primary pallet member can be readily fixed to a bottom sled to form a pallet assembly. The sled has laterally spaced openings for forklift handling. The sled also provides protection for the primary pallet member including conveyance on a work line and allows the article to be readily placed or built-up on the primary pallet. In the event automatic handling is used, the primary pallet is separated from and used without its sled for completed seat conveyance or for seat built-up and subsequent handling and conveyance.

9 Claims, 7 Drawing Sheets

FIG-7
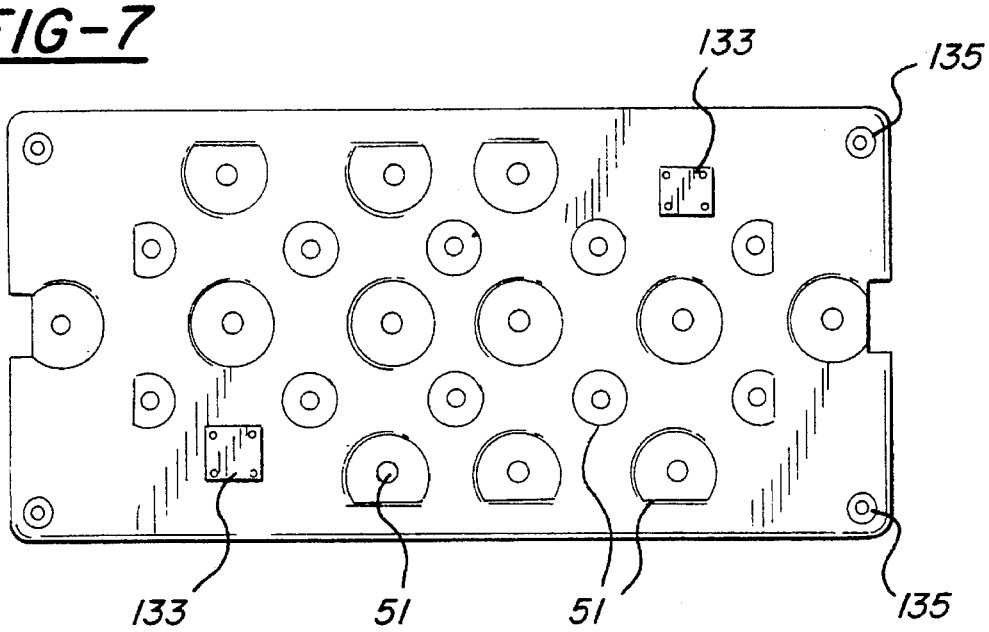
FIG-8
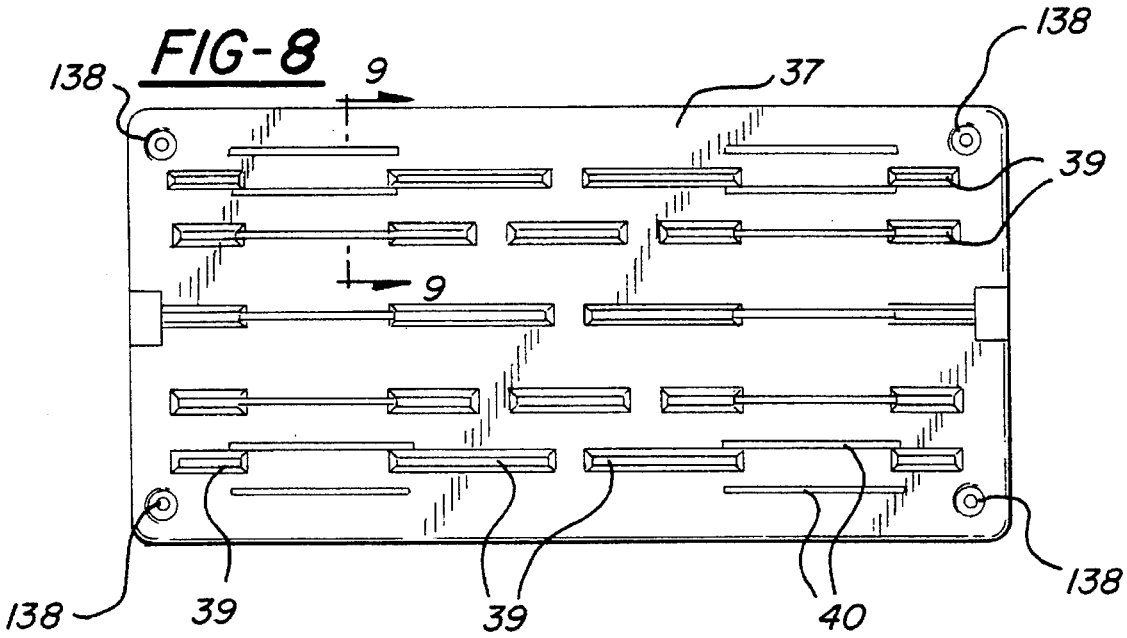
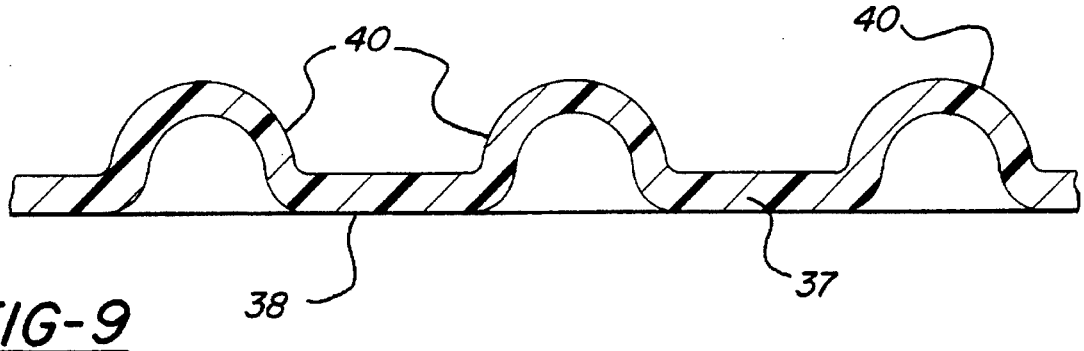
FIG-9

PALLET WITH ADJUSTABLE ARTICLE MOUNTING HARDWARE AND ARTICLE ATTACHMENT METHOD

BACKGROUND OF THE INVENTION

This invention relates to new and improved article supporting pallets and attachment methods in which attachment hardware is adjustably secured to a primary pallet member so that it can be selectively adjusted to accommodate a wide range of different articles of differing sizes, shapes and with different attaching points. In this invention, a primary pallet member can be releasably attached into a pocket of a protective shell-like sled to form a pallet assembly that augments forklift handling, line conveyance, article build-up or loading thereon and subsequent shipping.

Prior to the present invention, various pallet constructions have been provided with dunnage dedicated to specific articles being built and shipped. For vehicle seat build-up and shipment, for example, pallets of rugged plastics material have been provided with slots, springs, and clips with hog rings and various other fastener constructions fixed thereon have been devised so that the seat can be installed or built-up into a finished unit thereon. These pallets allow the seats to be subsequently conveyed as a module on a conveyor and shipped with the pallet to an assembly plant. At such plant, the seat assembly is removed from the pallet and installed in the body of an automotive vehicle being built.

While such prior pallet constructions have materially advanced mass production techniques, the pallets and the article fasteners thereon are subject to significant damage and from high impact forces and loads. This damage frequently occurs when these pallets are moved on a line from an initial loading station to seat build-up and upholstery stations and then to a shipment station so that the seats held on the pallet can be loaded on a carrier for transport to an automotive assembly plant. At the plant, the pallets are subject to further damage from handling and conveyance as the seats are removed from the pallet and installed in a vehicle. The pallets are then collected together for repair or return to the seat assembly plant for reuse.

In addition to damage from handling, the prior art pallets are generally dedicated to the shipment of certain articles. For example, the pallets for seat build-up and shipment have permanently fixed attachment slots and hardware to accommodate only certain types and sizes of seats. If different seat constructions are to be shipped, the pallets are sent to a retrofit facility where the pallets are rebuilt or repaired if necessary. Often the original attachment devices are removed and replaced by different attachment and securing devices at locations different from those of the original to suit different sizes or types of articles to be conveyed. The new devices are permanently fixed thereby making the retro fitted pallet permanently dedicated to the different articles to be conveyed. Such retrofitting is time consuming and costly and results in other inherent inefficiencies such as dead head shipping, storage, weather and work delays causing increased costs which are generally added to the price of the finalized product.

With the above problems in mind, this invention is directed to a new and improved pallet assembly which has a primary load carrying primary pallet member that has article attachment bracketry thereon. This bracketry can be readily adjusted and changed to accommodate a wide range of sizes and types of articles to be carried thereon so that off-site adjustments, repairs and retrofits are substantially reduced or eliminated. In this invention, a special protective shell or sled is provided in which the primary pallet member can be secured so that damage thereto is sharply reduced. The sled augments conveyance on a line and has handling features such as large laterally-spaced openings for handling by fork lifts or other transfer machinery. The peripheral walls of the sled surround and protect the primary pallet and its article attachment bracketry from mechanical damage. For highly automated systems, the primary pallet and sled are separated from one another so that the primary pallet can be used without the sled since it can be readily handled and conveyed by automated equipment. When used without the sled, there is a reduction in pallet bulk and weight so that economies are obtained in handling and shipping pallets.

In one embodiment of this invention, a dual section pallet assembly has a primary pallet fitted with article attachment brackets that are adjustably mounted on the upper surface thereof to accommodate a wide range of different styled articles, such as seats for automobiles. These brackets include adjustable front and rear attachment devices with vertical and horizontal pins to fit into attachment openings in seat support construction so that the seats are releasably secured on the pallet in a manner suitable for handling and conveyance. The horizontal and vertical attachment pins are accordingly adjustably mounted to the pallet to provide article connections that augment easy securement of articles of different sizes on the pallet and easy removal therefrom. The primary pallet can be readily fixed to a bottom sled provided with openings for forklift handling and with peripheral walls so that the primary pallet and its attachment brackets are protected from breakage or other damage during handling and conveyance on a work line for example. The primary pallet by itself, or the unitized multiple part pallet, allows seats and other articles to be built on the primary pallet so that assembly is enhanced. The primary pallets are readily removed from the associated sleds so that they be handled and transferred by automatic equipment such as stacking and unstacking units. Also, the primary pallets can be automatically conveyed from the line to a transport vehicle after the articles have been attached to the pallet for subsequent shipment to an assembly plant.

It is a feature, object and advantage of this invention to provide a new and improved pallet comprising a primary pallet with bracketry which is readily adjustable for carrying a wide range of articles of different sizes such as seats for vehicles and for carrying a wide range of different articles.

Another feature, object and advantage of this invention is to provide a new and improved sled which can be employed to be assembled with and to carry a primary pallet that enhances handling by forklift, or other article handling and transfer units, and to protect the primary pallet and its dunnage from breakage or other damage that may otherwise occur during movement on a line to a predetermined station.

Another feature, object and advantage of this invention is to provide a new and improved method for automating production employing pallets with adjustable brackets and optional pallet supporting sleds to carry different types of similar articles and a wide range of different articles.

These and other features, objects and advantages of this invention will become more apparent from the following description and drawings in which:

DESCRIPTION OF THE DRAWINGS

FIG. 7 is a bottom view of the primary pallet taken along line 7—7 of FIG. 2;

FIG. 8 is a bottom view of the pallet carrier of FIGS. 6A and 6B;

FIG. 9 is a sectional view taken along sight lines 9—9 of FIG. 8.

DETAILED DESCRIPTION OF THE DRAWINGS

Figure 6A:
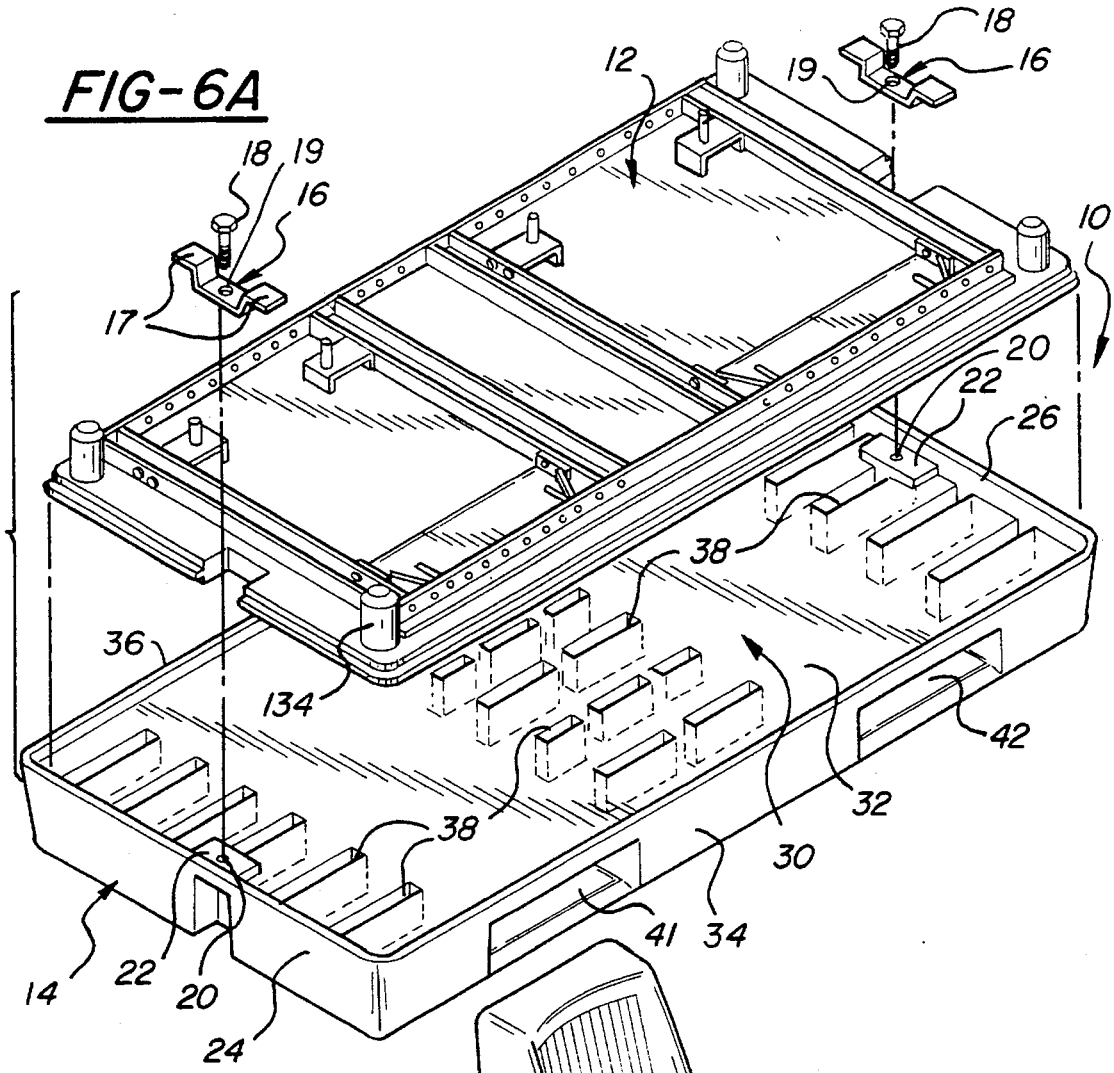
FIG. 6A is an exploded pictorial view of the primary pallet and pallet carrier of this invention.
Figure 6B:
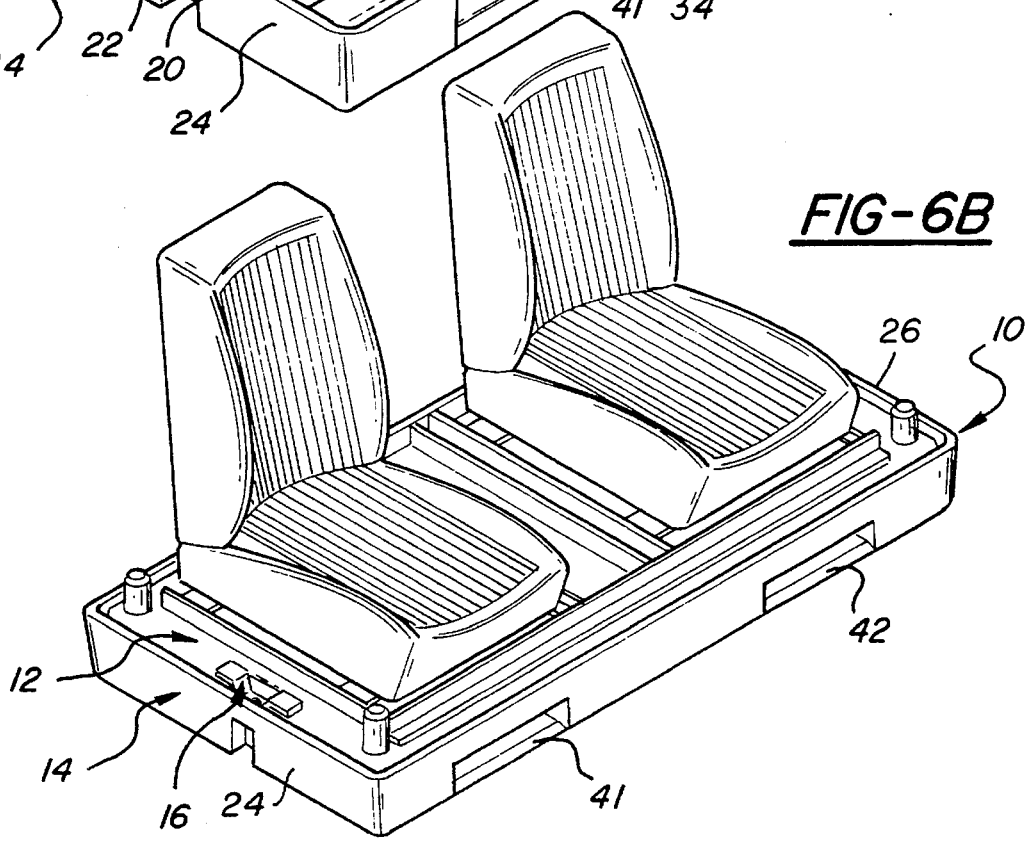
FIG. 6B is a pictorial view of the primary pallet with seats for a vehicle releasably mounted thereon.

Turning now in greater detail to the drawings, there is shown in FIGS. 6A and 6B a pallet assembly 10 comprising an article-supporting, generally rectangular primary pallet 12 that is seated in a lower shell-like sled or pallet carrier 14. The primary pallet and lower sled are releasably secured together by a pair of U-shaped straps 16 formed with end portions 17 extending outwardly from upwardly projecting legs along the outer face of the primary pallet. Elongated threaded fasteners 18 which extend through openings 19 in the central webs of the straps thread into openings 20 provided in end tabs 22 of the sled to effect the connection of the primary pallet and sled components of the pallet assembly 10. Preferably, tabs 22 are integral with and project inwardly from the left and right upstanding peripheral sidewalls 24, 26 of the sled.

The primary pallet 12 nests into the generally rectilinear pocket 30 formed by the outer flat surface of upper wall 32 of the sled and the bounding left and right sidewalls 24, 26, and front and rear sidewalls 34, 36. The sled and its sidewalls are convexly curved at its corners so that it will not readily catch on transfer line components or entangle with other pallet assemblies.

With this construction, the primary pallet 12 can be placed into the pocket 30 so that it is supported on the outer surface of upper wall 32 of the sled 14. The straps 16 and threaded fasteners 18 allow the primary pallet unit to be tightly but releasably secured to the sled to form the pallet assembly 10. With this assembly, peripheral wall of the sled can protect the primary pallet and any attachment devices and articled thereon, particularly, as the pallet assembly is being handled and conveyed.

The sled has a hollow main body with a flattened bottom wall 37 spaced from the upper wall 32 by aligned and inwardly extending supports 38 and 39, respectively, formed as pockets in these walls. The ends of the supports meet midway in the hollow main body of the sled and may be securely joined at their interfacing ends to increase sled strength and carrying capacity. Furthermore, the lower wall 37 is formed with elongated strengthening ribs 40 as shown best in FIGS. 8 and 9.

For forklift handling, the sled 14 has laterally spaced and transversely extending openings 41, 42 leading from the front or forward side 34 of the sled. These openings may extend over the reinforcement ribs 40 and are bounded on opposite sides by facing edge portions of the internal supports 38 and 39. The fork lift openings may extend through the rear side walls of the sled or to some point therebetween so that the forks of a forklift, or other handling equipment, operatively fit into the sled with stability allowing the pallet assembly to be easily handled.

Figure 3:
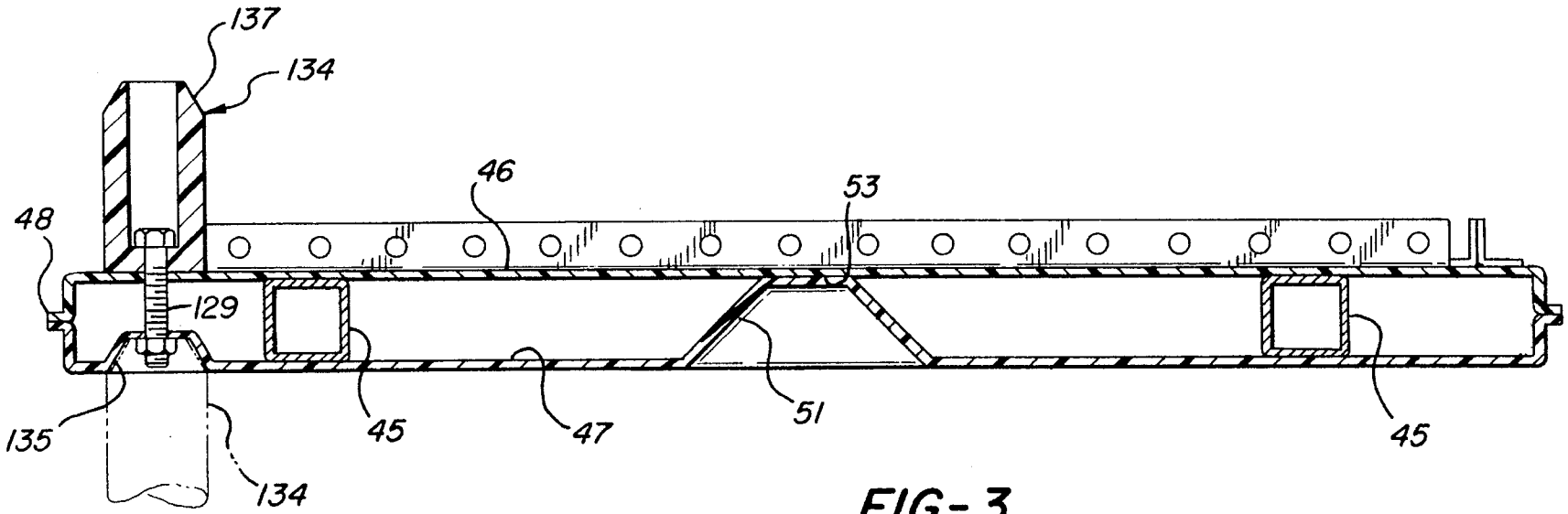
FIG. 3 is a sectional view of the primary pallet as taken generally along sight lines 3—3 of FIG. 1.

The sled and the primary pallet are both molded from tough, impact resisting, high-density polyethylene or other plastics material to minimize damage such as from contact with one another or from handling equipment. The primary pallet, as shown in FIG 3 may be made from thick top and bottom sheets 46, 47 of plastic material joined together at contact points and a peripheral seam 48 such as by thermal bonding. To further improve the strength of the primary pallet, hollow peripheral steel tubing 45 is sandwiched between the sheets to form an interior reinforcement adjacent to the periphery of the pallet. The lower or bottom sheet 47 may be formed with truncated cones 51 whose flattened upper ends 53 are thermally bonded to the inside surface of the upper or top sheet 46.

Figure 1:
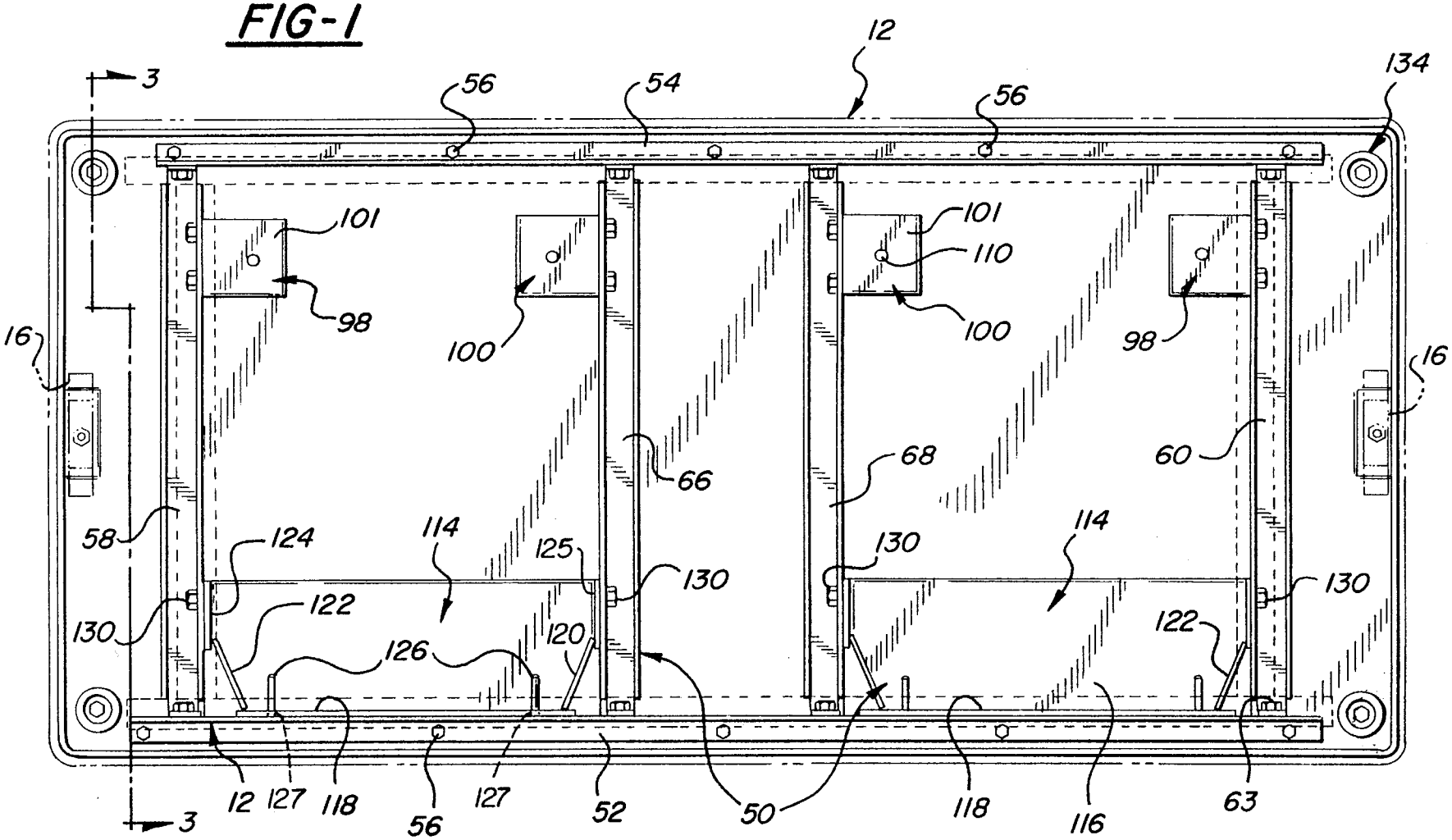
FIG. 1 is a top view of a primary pallet assembly with adjustable article support bracketry.
Figure 2:
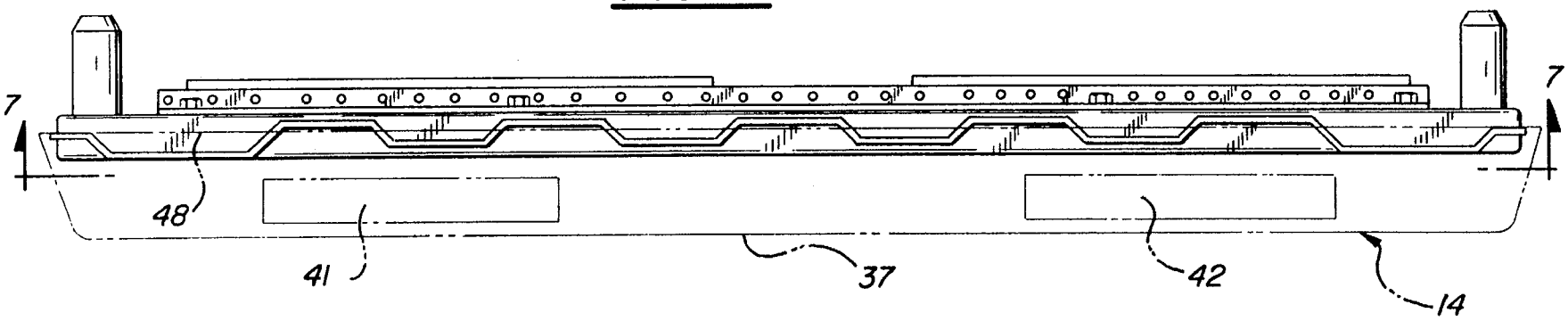
FIG. 2 is a front elevational view of the primary pallet of FIG. 1 and an associated pallet carrier therefor shown in phantom lines.
Figure 4:
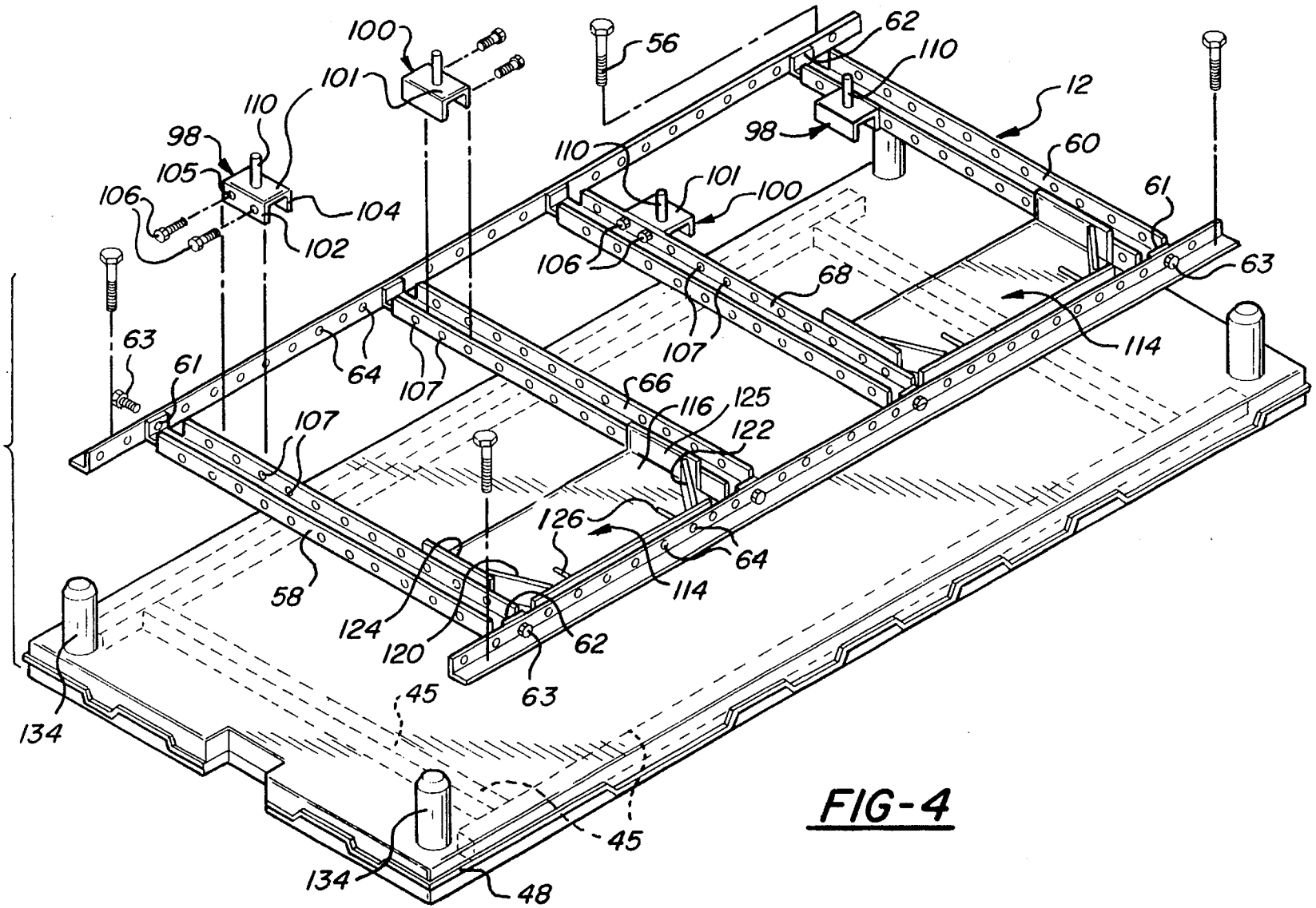
FIG. 4 is a partly exploded pictorial view with parts not shown of the primary pallet of FIGS. 1–3.

The primary pallet 12, as shown in FIGS. 1 and 4 is provided with dunnage in the form of adjustable bracketry 50. This bracketry comprises front and rear brackets 52, 54, each preferably being a linear metallic member, L-shaped in cross-section, connected by threaded fasteners 56 to the upper side of the primary pallet. Mounted between the front and rear metallic brackets or channels are left and right side brackets 58 and 60, U-shaped in cross-section, with attachment ears 61, 62 bent upwardly at opposite ends thereof, shown best in FIG. 4, which are provided with central openings so that threaded fasteners 63 can be used to secure the side brackets to the front and rear bracket. The side brackets 58, 60 can be adjusted along the extent of the front and rear brackets to accommodate the dimensions of a wide size range of articles to be conveyed on the primary pallet.

Intermediate brackets 66, 68 are similar to the side brackets and can be adjusted and fixed at any of a wide range of positions parallel with the side brackets, such as shown in FIG. 1. The horizontal line of adjustment holes 64 in the forward and rear brackets 52 and 54 are for the adjustment of the side and intermediate brackets. In one preferred embodiment of the invention, the left side bracket 58 and the intermediate bracket 66 provide a portion of the attachment dunnage for a first article to be secured thereto while intermediate bracket 68 and the right side bracket 60 provide another portion of the attachment dunnage of the second article to be transmitted. As shown in FIG. 4B, the article to be conveyed may comprise automotive seat assemblies or units 70, 72, each having a generally horizontal seat 74 and backrest 75 extending upwardly from a rear portion thereof.

Figure 4A:
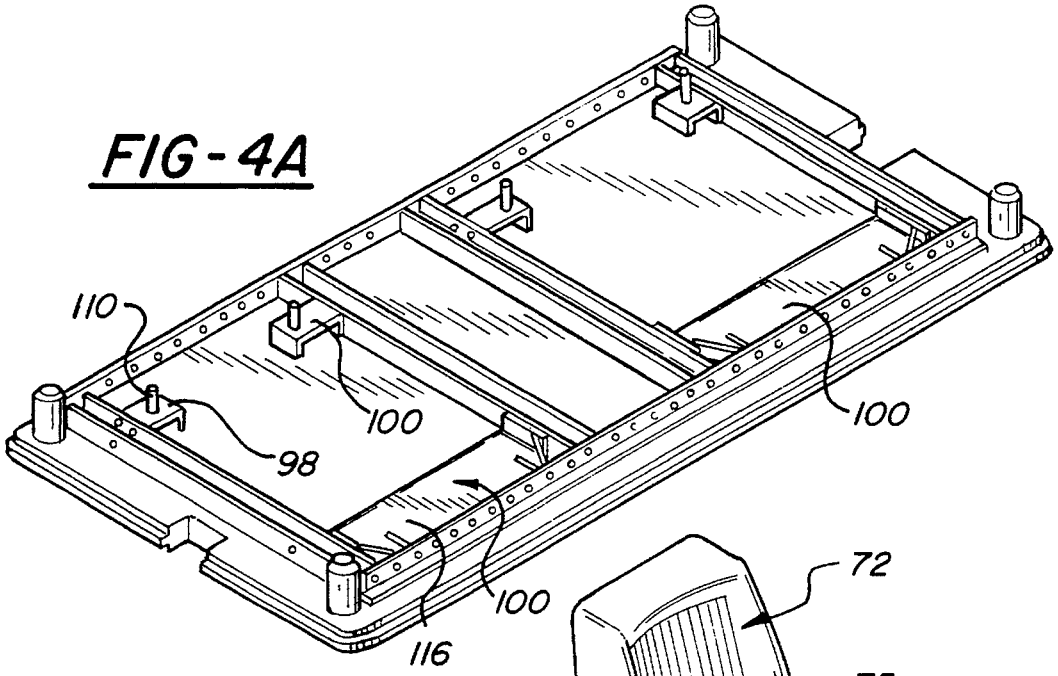
FIG. 4A is pictorial view of the primary pallet with adjustable hardware and mounting bracketry secured thereto.
Figure 4B:
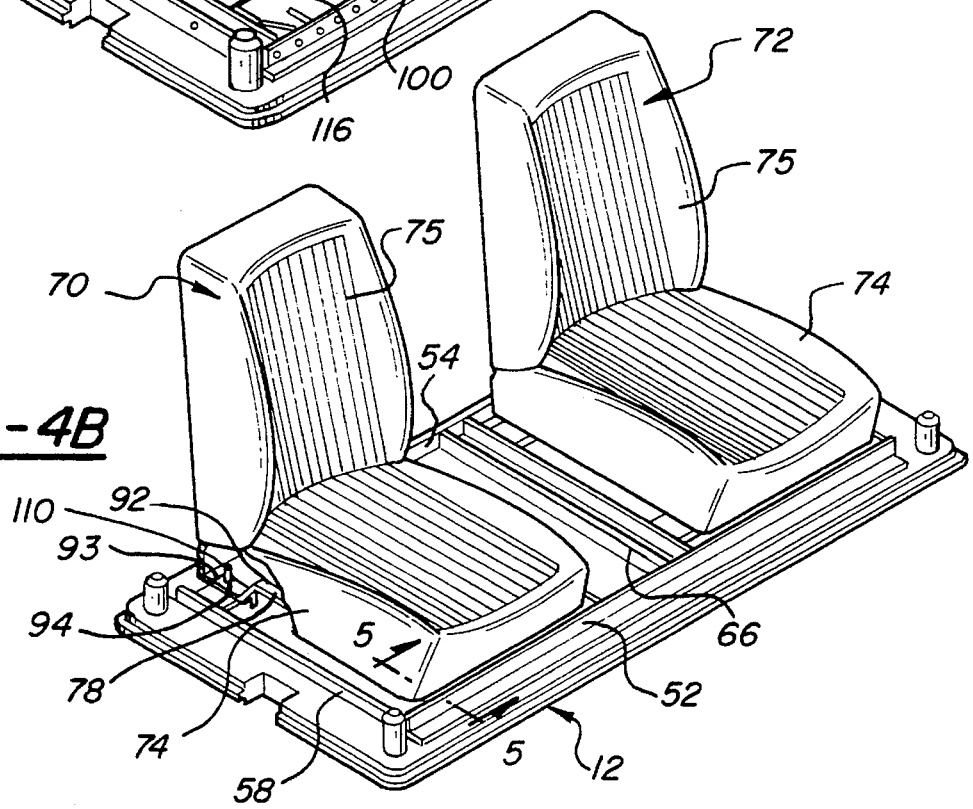
FIG. 4B is a pictorial view of modular seats, partly broken away, supported on the primary pallet.
Figure 5:
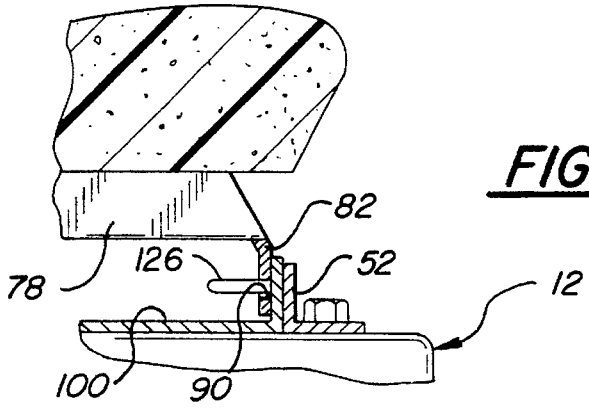
FIG. 5 is a sectional view of a portion of the primary pallet taken generally along sight lines 5—5 of FIG. 1.

Each seat assembly 70, 72 has conventional seat support structure including a pair of parallel rails 78, one of which is partly shown in FIGS. 4B and 5, that normally mount to the support structure on the floor of a vehicle body by a pair of conventional forward legs, one of which is shown at 82. These legs are formed with horizontal openings 90. These openings 90 normally accommodate threaded fasteners, not shown, that are employed to secure the support rails and the seat assembly within the vehicle body. Rear legs 92, only one of which is shown, also secured to the seat rails extend downwardly therefrom and each terminates in a flat horizontal foot 93 having vertically directed hole 94 also to receive threaded fasteners, not shown, for securing the rearward section of the rails to the vehicle body. The seat assemblies are accordingly conventionally mounted in the vehicle for fore and aft adjustment on the rails for driver and passenger comfort.

The present invention advantageously utilizes the forward legs and rear legs in the attachment of the seat assemblies 70 or 72 to the primary pallet 12. To this end, the side brackets 58 and 60 and neighboring intermediate brackets 66, 68 have rearward pedestals or pads 98, 100, respectively, each having a flat upper support wall 101 spanning downwardly extending side support legs 102 and 104. These legs contact the upper surface of the primary pallet for the stabilized support of the pedestals. The outboard side support legs, such as leg 102, have openings 105 therethrough that receive horizontal fasteners 106 that extend through adjustment openings 107 in the vertical walls of the of the side and intermediate brackets 58, 60 and 66, 68 so that the pedestals or pads can be adjusted and tightly secured at desired positions to the side and intermediate brackets to accommodate the fixed positions of the front seat support structure.

As shown, one or both of the upper support walls of the support pedestals 98, 100 have upwardly or vertically extending attachment pins 110 that fit into the elongated openings 94 in the flattened feet 93 of the seat support legs 92 so that the seat assembly can be mounted and retained in a stabilized position on the pallet 12.

To prevent seat movements such as seat rocking while on the pallet 12, seat attachment trays 114 are provided. Each attachment tray 114 is a receptacle with an open end, a bottom plate 116, forward wall 118, opposing side walls 120 and 122 that diverge outwardly from the forward wall 118 to parallel connector ends 124, 125 that fit against the sides of side and intermediate brackets 58, 66 and 60, 68. The side walls 120, 122 of the trays 114 converge onto forward wall 118 to guide the seat assembly 70, 72 into the attachment tray so that forward legs support 92 and the horizontal holes 94 readily align with attachment pins 126 that project horizontally from the forward wall of the tray. The forward walls of the trays may be provided with a plurality of horizontal openings 127 so that the pin can be moved to different positions to fit into different opening in other seats or articles being mounted on the primary pallet. Also, the trays can be provided within varying widths or made in several parts for the adjustment of the brackets.

Threaded fasteners 130 are inserted through aligned holes in the connector end walls of the attachment trays 114 and in the brackets 58, 66 and 60, 68. With this construction, the tray can be adjusted in a selected forward or aft position between the side and intermediate brackets to accommodate articles with different attachment points. Furthermore, pins 126 of the trays can also be adjusted laterally by movement to different openings optionally provided in forward wall 118 to accommodate different attachment points of the article being conveyed.

To secure a completed seat assembly on the primary pallet or a pallet assembly, the seat assembly may be moved until the pins 126 fit into the horizontal holes 90 of the seat support legs 82. After this pin connection, the rear of the seat assembly is lowered so that the vertical attachment pins 110 of the support pedestals 98, 100 extend through the elongated opening 94 of the rearward feet of the seat assembly.

The horizontal pins prevent the seat assembly from pivoting or otherwise coming loose from the pallet when mounted thereon. For example, if the truck carrying seat assemblies on a pallet suddenly stops, the horizontal pins will prevent the seats from rocking and possibly turning over. The vertical pins prevent any excessive fore and aft motions while both pins prevent excessive side to side movements of the seat assemblies relative to the pallets 12.

FIGS. 4A, 4B and FIG. 5 show the primary pallet 12 with the sled 14 removed. In this configuration, the pallet can be readily used with automatic stackers, unstackers and other automatic handling equipment. Accordingly, the primary pallet 12 augments automated production without the use of the bulky sled employed for forklift handling. The underside of the primary pallet may have sensor information discs 133 therein. With such discs, sensors along the transfer line can sense the position and other information about the pallet and its burden.

The primary pallet 12 is strengthened by the internal, generally rectilinear, tubular reinforcing frame 45 of a suitable metal or plastics material. The frames are completely encased by the formed upper and lower sheets 46, 47 of the primary pallet and is immediately inboard of the peripheral edges thereof.

The sheets 46 and 47 are heat welded at interfacing areas, such as seam 48, also the tops of truncated cones 51 formed in the bottom sheet 47 are heat welded to the upper sheet for strengthening purposes.

The primary pallet 12 is provided with elongated generally cylindrical stacking posts 134 of plastics material attached to and extending upwardly from the corners of the upper surface thereof which can be received into aligned conical pockets 135 in bottom of another primary pallet so that the primary pallets can be stacked and secured one on top of the other. FIG. 3 shows post 134 attached by bolt 129 to the upper pallet with its free end tapered at 137 so that it can fit into the tapered aligned pocket 135 of a second primary pallet stacked thereon. Pockets 138 are also provided in the sleds so that pallet assemblies can be securely stacked one atop the other.

Figure 10:
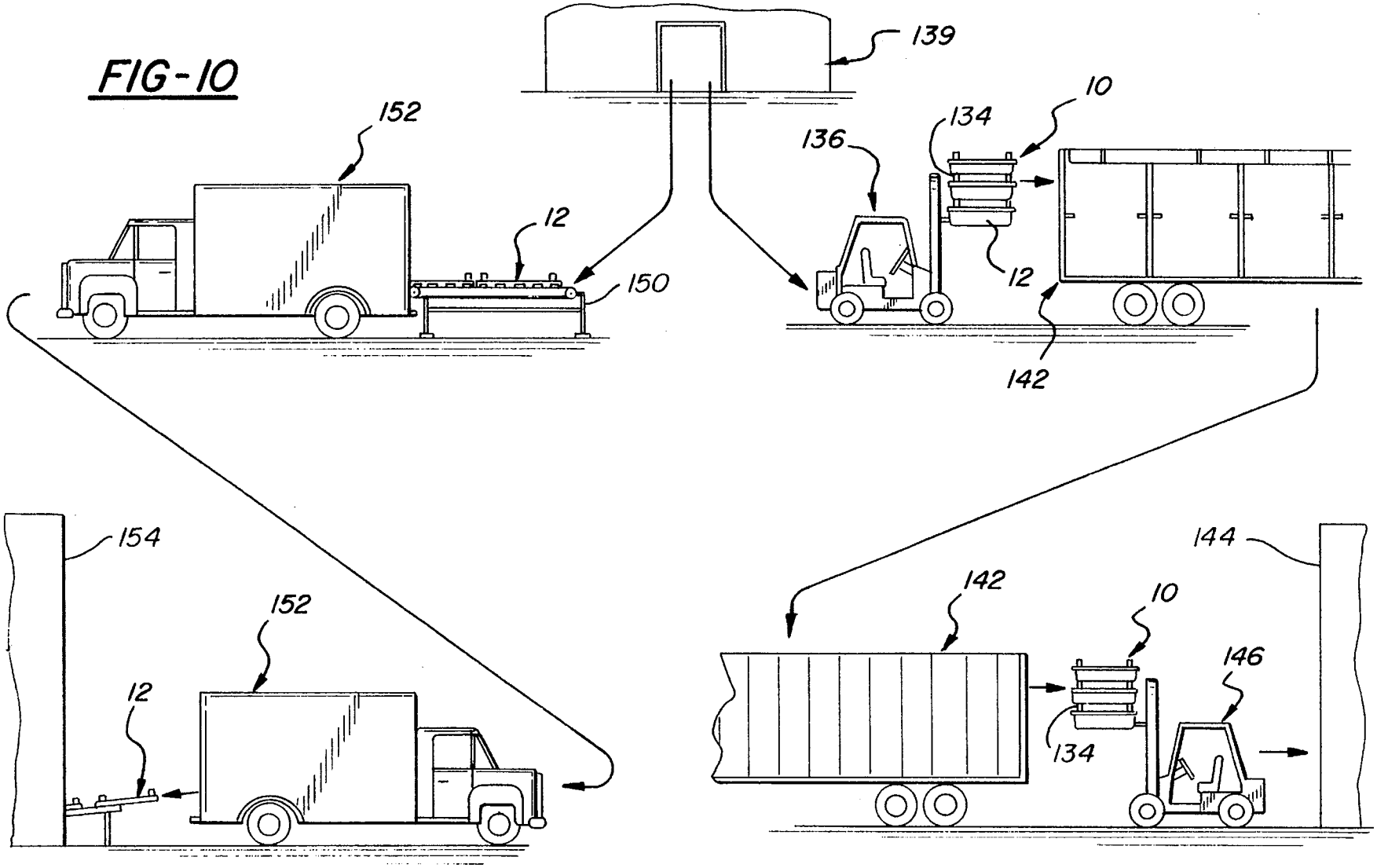
FIG. 10 is a diagram illustrating transport of the primary pallet and the pallet assembly.

FIG. 10 shows the pallet assemblies 10, stacked with stability provided by the stacking posts 134, being moved by forklift 136 from a supply of pallet assembly in warehouse 139 into a semi-trailer 142. The trailers are driven to a seat assembly facility 144. There the pallet assemblies 10 are unloaded by a forklift 146 and stacked beside an assembly line so that they can be subsequently placed on a line that conveys the pallet assembly to seat build-up or seat installation stations within the facility. With the seat assembly build-up or unit installed on the pallet assembly, the seat assembly is securely held on the primary pallet by the attachment pins 110, 126 so that fore and aft, side-to-side, and rocking motions of the seats are eliminated during shipment to an assembly plant. The pins allow quick and efficient removal of the seat assemblies from the pallets.

In the event that automatic handling equipment is available, the primary pallets 12 are shipped without their sleds 14 as shown in FIG. 4 The primary pallets 12 may be automatically unloaded by automatic handling equipment diagrammatically shown at 150 and from a supply in warehouse 139 and automatically conveyed to a transfer truck 152. After truck transport, the primary pallets 12 are automatically unloaded from the transfer truck to assembly plant 154 and automatically fed to a line where seats are build-up or mounted as completed assemblies onto the pallets for subsequent shipping to a vehicle assembly plant as previously described. Since the primary 12 pallets can be used without the sleds 14 in fully automated lines, economy is increased such as provided by the reduction in shipping and handling costs. When used in plants that are not fully automated, the primary pallets are readily usable since they can be installed in the sleds for forklift handling.

While a preferred embodiment of the invention has been shown and described, other embodiments will now become apparent to those skilled in the art. Accordingly, this invention is not to be limited to that which is shown and described but by the following claims.

What it claimed is:

1. A pallet for the attachment and conveyance of a wide range of articles with differing pallet attachment points comprising a primary pallet member having an upper support surface and peripheral edges, elongated front and rear bracket members, fasteners for securing said front and rear bracket members to said upper surface of said primary pallet member so that said bracket members are spaced in general parallel relationship from one another and are adjacent to said peripheral edges of said pallet member, left and right side bracket members, fasteners for securing said left and right bracket members between said front and rear brackets in general spaced parallel relationship to one another, intermediate bracket members disposed between said left and right bracket members, fastener means for adjustably securing said intermediate bracket members between said side bracket members and in general parallel relationship thereto, an article support associated with each of said side and intermediate bracket members for supporting and attaching an article to said primary pallet member, fastener means for adjustably mounting each said article support respectively to said side and intermediate bracket members associated therewith so that said supports can be adjusted to any of a plurality of positions along said left, right and intermediate brackets associated therewith to support the article.

2. The pallet of claim 1, and further including an additional second article support disposed adjacent to said front bracket member and adjustably secured between said side and intermediate bracket members to any one of a plurality of positions spaced from said front bracket members to accommodate the attachment and support of a wide range of articles with different attachment points.

3. The pallet of claim 2, wherein said additional second article support has horizontal pins and said article support associated with said side and intermediate bracket members has vertical pins, and wherein said pins provide attachments for reception in corresponding horizontal and vertical opening in the article being attached to said pallet.

4. The pallet of claim 2, wherein said article support associated with said side and intermediate bracket members has first securement pins extending in a first direction to a free end for reception in an attachment opening in said article, and wherein said second article support has attachment pins extending in another direction to a free end for reception in a horizontal attachment opening in said article.

5. The pallet of claim 1, and further including a mounting sled for receiving the pallet therein to form a pallet assembly, fasteners for releasably securing said primary pallet member within said sled, said sled having peripheral walls surrounding and protecting said pallet member.

6. The pallet of claim 5, wherein said sled has a pair of laterally spaced openings extending into one side thereof, said opening being spaced to receive elongated forks of a forklift so that said pallet assembly can be moved by a forklift.

7. A pallet for releasably mounting articles having a support structure with pallet attaching points to augment subsequent movement of the pallet mounted article comprising a primary pallet member having an upper attachment surface bounded by forward, rearward and left and right sides, said pallet having front and rear bracket members, fastener means for adjustably securing said front and rear bracket members adjacent to said forward and rearward sides of said Primary Pallet member respectively, left and right side bracket members, fastener means for adjustably securing said left and right side bracket members adjacent to said left and right sides of said Primary Pallet member respectively, intermediate bracket members disposed between said left and right side bracket members, fastener means for adjustably securing said intermediate bracket members to said and rear bracket members in parallel relationship to said left and right side bracket members to accommodate a plurality of articles for support on said primary pallet member, and support pads associated with said side bracket members and intermediate bracket members, at least some of said support pads having a pin means extending upwardly therefrom for connection with the pallet attachment points of the support structure of said articles, and fasteners for adjustably mounting said support pads to said side and intermediate bracket members so that the support pads can be selectively positioned to match the position of said pallet attachment points of said article and so that said pins will project through openings in said pallet attachment points to releasably support the article on said base member.

8. The pallet of claim 7, and further including a support tray extending between said intermediate and said side bracket members, attachment pin means on said support tray extending in a generally horizontal direction for connection with at least one opening in said pallet attachments to releasably secure the article to said pallet,

9. The pallet of claim 8, wherein said tray has converging side walls to guide the article being mounted on the pallet toward the attachment pin means on said tray.

* * * * *